US009599327B2

(12) United States Patent
Tarter et al.

(10) Patent No.: US 9,599,327 B2
(45) Date of Patent: Mar. 21, 2017

(54) SWITCH FOR BATTERY FLASHLIGHT TO CHANGE MODES

(71) Applicants: 5.11, Inc., Modesto, CA (US); Insight 2 Design, Inc., Overland Park, KS (US)

(72) Inventors: Kevin Tarter, Overland Park, KS (US); Daniel DeBrunner, Kansas City, MO (US)

(73) Assignees: 5.11, INC., Modesto, CA (US); INSIGHT 2 DESIGN, INC., Overland Park, KS (US)

( * ) Notice: Subject to any disclaimer, the term of this patent is extended or adjusted under 35 U.S.C. 154(b) by 68 days.

(21) Appl. No.: 14/599,378

(22) Filed: Jan. 16, 2015

(65) Prior Publication Data

US 2015/0204529 A1 Jul. 23, 2015

Related U.S. Application Data

(60) Provisional application No. 61/928,934, filed on Jan. 17, 2014.

(51) Int. Cl.
*F21V 23/04* (2006.01)
*F21L 4/00* (2006.01)

(52) U.S. Cl.
CPC ..... *F21V 23/0414* (2013.01); *F21L 4/00* (2013.01); *Y10T 29/49002* (2015.01)

(58) Field of Classification Search
CPC ..... F21V 33/0414; F21V 23/0407; F21V 23/0421; F21V 23/0428; F21V 23/04;
(Continued)

(56) References Cited

U.S. PATENT DOCUMENTS 4,166,680 A 9/1979 Maitani
4,841,417 A 6/1989 Maglica et al.
(Continued)

FOREIGN PATENT DOCUMENTS

CN 202756922 U 2/2013
GB 2259358 A 3/1993

OTHER PUBLICATIONS

I.Q. Switch. [online]. Nite Ize, Jan. 6, 2014 [retrieved on Jan. 6, 2014]. Retrieved from the Internet: <URL: http://www.niteize.com/product/IQ-Switch.asp>, 2 pages.
(Continued)

*Primary Examiner* — Bao Q Truong
(74) *Attorney, Agent, or Firm* — Kilpatrick Townsend & Stockton LLP

(57) ABSTRACT

A multi-mode portable lighting assembly, such as a flashlight, is disclosed. The portable lighting assembly may include a plurality of lighting elements controllable by a plurality of switches. A first switch may be disposed on an outside portion of the portable lighting assembly and may therefore be accessible to a user under normal operating conditions. A second switch may be disposed within a compartment of the portable lighting assembly and may therefore be inaccessible to the user under normal operating conditions. The second switch may also be disposed on the outside portion of the portable lighting assembly. The second switch may have a plurality of positions and dependent on the selected position, the second switch may dictate the operation of the first switch with respect to the plurality of lighting elements.

19 Claims, 4 Drawing Sheets

(58) Field of Classification Search
CPC ..... F21V 99/00; F21V 23/0414; F21V 25/00; F21L 4/00; F21L 4/005; F21L 4/022; F21L 4/045; F21L 4/085; Y10T 29/49002
See application file for complete search history.

(56) References Cited

U.S. PATENT DOCUMENTS

| | | | | |
|---|---|---|---|---|
| 5,412,548 | A | 5/1995 | Yee | |
| 5,473,521 | A | 12/1995 | Minshall | |
| 6,296,371 | B1 | 10/2001 | Shiau | |
| 6,794,589 | B2 | 9/2004 | Kubat et al. | |
| 6,808,287 | B2 | 10/2004 | Lebens et al. | |
| 6,814,464 | B2 | 11/2004 | Galli | |
| 6,814,466 | B2 | 11/2004 | Parsons et al. | |
| 6,971,762 | B2 | 12/2005 | Galli | |
| 7,199,316 | B2 | 4/2007 | Gorrie et al. | |
| 7,481,551 | B2 | 1/2009 | Sharrah | |
| 7,579,783 | B2 | 8/2009 | Millard et al. | |
| 7,581,844 | B1 * | 9/2009 | Yang | F21L 4/00 362/191 |
| 7,594,735 | B2 | 9/2009 | Kang et al. | |
| 7,674,003 | B2 | 3/2010 | Sharrah et al. | |
| 7,731,385 | B2 | 6/2010 | Spartano et al. | |
| 7,800,313 | B1 | 9/2010 | Allen et al. | |
| 7,850,330 | B2 * | 12/2010 | Spartano | F21L 4/027 362/194 |
| 8,096,674 | B2 | 1/2012 | Matthews et al. | |
| 8,258,416 | B2 | 9/2012 | Sharrah et al. | |
| 8,360,598 | B2 | 1/2013 | Sharrah et al. | |
| 8,376,571 | B2 | 2/2013 | Rorick | |
| 8,376,574 | B2 | 2/2013 | Spartano et al. | |
| 8,425,078 | B2 | 4/2013 | Matthews et al. | |
| 8,456,319 | B2 | 6/2013 | Baker et al. | |
| 8,491,151 | B2 * | 7/2013 | Spartano | F21L 4/027 315/291 |
| 8,507,819 | B2 | 8/2013 | Steinicke et al. | |
| 8,610,372 | B2 * | 12/2013 | Rothschild | H05B 37/02 315/200 A |
| 2004/0190288 | A1 | 9/2004 | Hsu | |
| 2008/0130274 | A1 * | 6/2008 | Fails | F21S 9/022 362/157 |
| 2010/0090613 | A1 * | 4/2010 | Spartano | F21L 4/027 315/287 |
| 2011/0204818 | A1 * | 8/2011 | Spartano | H05B 37/0209 315/294 |
| 2012/0146552 | A1 | 6/2012 | West | |
| 2012/0249018 | A1 | 10/2012 | West | |
| 2012/0274774 | A1 | 11/2012 | Bushee | |
| 2013/0033609 | A1 | 2/2013 | Cadeus | |

OTHER PUBLICATIONS

LED Shop Lamps. [online]. Attention to Detail Machining and Electronic Services, 2012 [retrieved on Nov. 20, 2013]. Retrieved from the Internet: <URL: http://atdms.com/led_shop_lamps.html>, 7 pages.

TK35 LED Flashlight. [online]. Fenix, Sep. 2012 [retrieved on Jan. 6, 2014]. Retrieved from the Internet: <URL: http://www.fenixlighting.com/products/fenix-flashlights-tk35-led-flashlight.aspx>, 2 pages.

* cited by examiner

SWITCH FOR BATTERY FLASHLIGHT TO CHANGE MODES

CROSS-REFERENCES TO RELATED APPLICATIONS

The present application claims the benefit of U.S. Provisional Application No. 61/928,934, filed Jan. 17, 2014, the full disclosure of which is incorporated herein by reference.

BACKGROUND

The references cited below are being called to the attention of the Office. Copies of the references are not enclosed. While Applicant herein discloses these references, no inference should be made that the information and references cited are prior art merely because they are in this statement and no representation is being made that a search has been conducted or that this statement encompasses all the possible relevant information. Accordingly, Applicant brings the following references to the Office's attention:

| Reference | Title |
|---|---|
| U.S. Pat. No. 4,166,680 | Strobo Unit For Camera |
| U.S. Pat. No. 4,841,417 | Tailcap Switch-focus Flashlight |
| U.S. Pat. No. 5,412,548 | Multi-function Lighting Device |
| U.S. Pat. No. 5,473,521 | Flashlight With Detachable Battery Terminals |
| U.S. Pat. No. 6,296,371 | Flashlight With Tail Cap Switch Assembly |
| U.S. Pat. No. 6,794,589 | Multiple Electrical Switch Arrangement |
| U.S. Pat. No. 6,808,287 | Method And Apparatus For A Pulsed L.e.d. Illumination Source |
| U.S. Pat. No. 6,814,464 | Waterproof Flashlight Assembly |
| U.S. Pat. No. 6,814,466 | Dual Switch Flashlight |
| U.S. Pat. No. 6,971,762 | Dual Mode Switch Mechanism For Flashlights |
| U.S. Pat. No. 7,199,316 | Multifunction Switch For Operating A Device In A Sealed Container |
| U.S. Pat. No. 7,481,551 | Flashlight Having Back Light Elements |
| U.S. Pat. No. 7,579,783 | Microprocessor-controlled Insertable Flashlight Adapter Device |
| U.S. Pat. No. 7,594,735 | Multi-switch Flashlight |
| U.S. Pat. No. 7,674,003 | Flashlight Having Plural Switches And A Controller |
| U.S. Pat. No. 7,731,385 | Multi-mode Flashlight |
| U.S. Pat. No. 7,800,313 | Multi-mode Led Retrofit Module Apparatus And Method |
| U.S. Pat. No. 8,096,674 | Lighting Device With Selectable Output Level Switching |
| U.S. Pat. No. 8,258,416 | Electrical Switch And Flashlight |
| U.S. Pat. No. 8,360,598 | Flashlight Having A Switch For Programming A Controller |
| U.S. Pat. No. 8,376,571 | Emergency Switch For A Flashlight |
| U.S. Pat. No. 8,376,574 | Multi-spectrum Lighting Device Having A Plurality Of Illumination Modes |
| U.S. Pat. No. 8,425,078 | Lighting Device With Multi-position Joystick |
| U.S. Pat. No. 8,456,319 | Switch Arrangement For A Lighting Device |
| U.S. Pat. No. 8,507,819 | Multi-functional Flashlight |
| US Application No. 2004/0190288 | Multi-purpose Flashlight |
| US Application No. 2012/0146552 | Portable Lighting Device With Reconfigurable User Interface |
| US Application No. 2012/0249018 | Multi-mode Portable Lighting Device |
| US Application No. 2012/0274774 | Multifunction Flashlight |
| US Application No. 2013/0033609 | Multifunctional Flashlight |
| CN Patent No. CN202756922U | Flashlight And Tail Portion Control Device Thereof |
| GB Patent No. GB2259358 | Multi-function Flashlight |
| http://atdms.com/led_shop_lamps.html | Attention to Detail Machining and Electronic Services |
| http://www.niteize.com/product/IQ-Switch.asp | I.Q. Switch Fits: AA Mini Maglite |
| http://www.fenixlighting.com/products/fenix-flashlights-tk35-led-flashlight.aspx | Fenix LED Flashlight TK35 |

In recent years, the availability of high power battery-operated flashlights has dramatically increased. This is partially a result of advances in the fields of light-emitting diode (LED) technology, rechargable battery technology, and printed circuit board (PCB) technology. A user today may select from a multitude of different flashlights to meet a variety of needs. This, however, can be costly and inefficient for a manufacture to tool up and produce the different flashlights, costly to a distributor/retailer that must stock the different flashlights, and costly and ineffecient to the user who must purchase the different flashlights (e.g., the extra time associated with sorting through multiple flashlights to find a desired one when purchasing and later during use). Multi-mode flashlights have been introduced in an attempt to meet the variety of needs of users. While a multi-mode flashlight may be able to meet a narrow number of the users' needs, its ability to meet all needs is often limited by the unalterable factory configuration of its switches. In addition, current multi-mode flashlights often are prone to failure because of the increased number of exposed switches required to achieve different modes. Thus, the costs of manufacturing and stocking multiple flashlights for different uses may pose challenges to manufactures and retailers. These costs, in addition to other costs associated with purchasing multiple flashlights for different uses, may be passed on to users. These costs, along with the difficulty and limitations associated with operating current multi-mode flashlights, may pose challenges to users, especially to first responders.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with at least one embodiment, a portable lighting assembly includes a lighting element, a compartment configured to receive one or more battery cells, a controller in electrical communication with the lighting element, an adjustable switch in electrical communication with the one or more battery cells and the controller, and a primary switch in electric communication with the lighting element and the controller and disposed on an outside surface of the compartment. The operation of the adjustable switch may cause a corresponding change in function provided by the primary switch via the controller for the lighting element.

For a fuller understanding of the nature and advantages of the present invention, reference should be made to the ensuing detailed description and accompanying drawings.

BRIEF DESCRIPTION OF THE DRAWINGS

Various embodiments in accordance with the present disclosure will be described with reference to the drawings, in which.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Embodiments of the present disclosure are directed to, among other things, a portable lighting assembly including an internal switch that is capable of adjusting the configuration of an external switch. In this manner, the portable lighting assembly may replace many different flashlights because depending on the position of the internal switch, the mode of the external switch is adjusted. The internal switch, as will be described in more detail below, may be disposed in a location that is inaccessible to a user during ordinary use, with the external switch disposed in a location that is accessible to the user during ordinary use. In some examples, the internal switch may be disposed within a battery compartment of the portable lighting assembly.

In embodiments, the portable lighting assembly is a flashlight. By flashlight, we mean a hand-held portable electric-powered light source. Usually the light source is a small incandescent light bulb or light-emitting diode (LED). A typical flashlight consists of a light bulb mounted in a reflector, a transparent cover (sometimes combined with a lens) to protect the light source and reflector, a battery, and a switch. These are supported and protected by a case or housing. The housing is typically configured as a cylinder or some other shape that fits the hand of a user.

Features herein can also be implemented in other portable and/or battery operated lights, such as, for example, headlamps, spotlights, lanterns, headlamps, and the like. Particular embodiments are directed to self-contained lighting assemblies that do not need external sources of power so that the lighting assemblies are usable while being transported.

Figure 1:
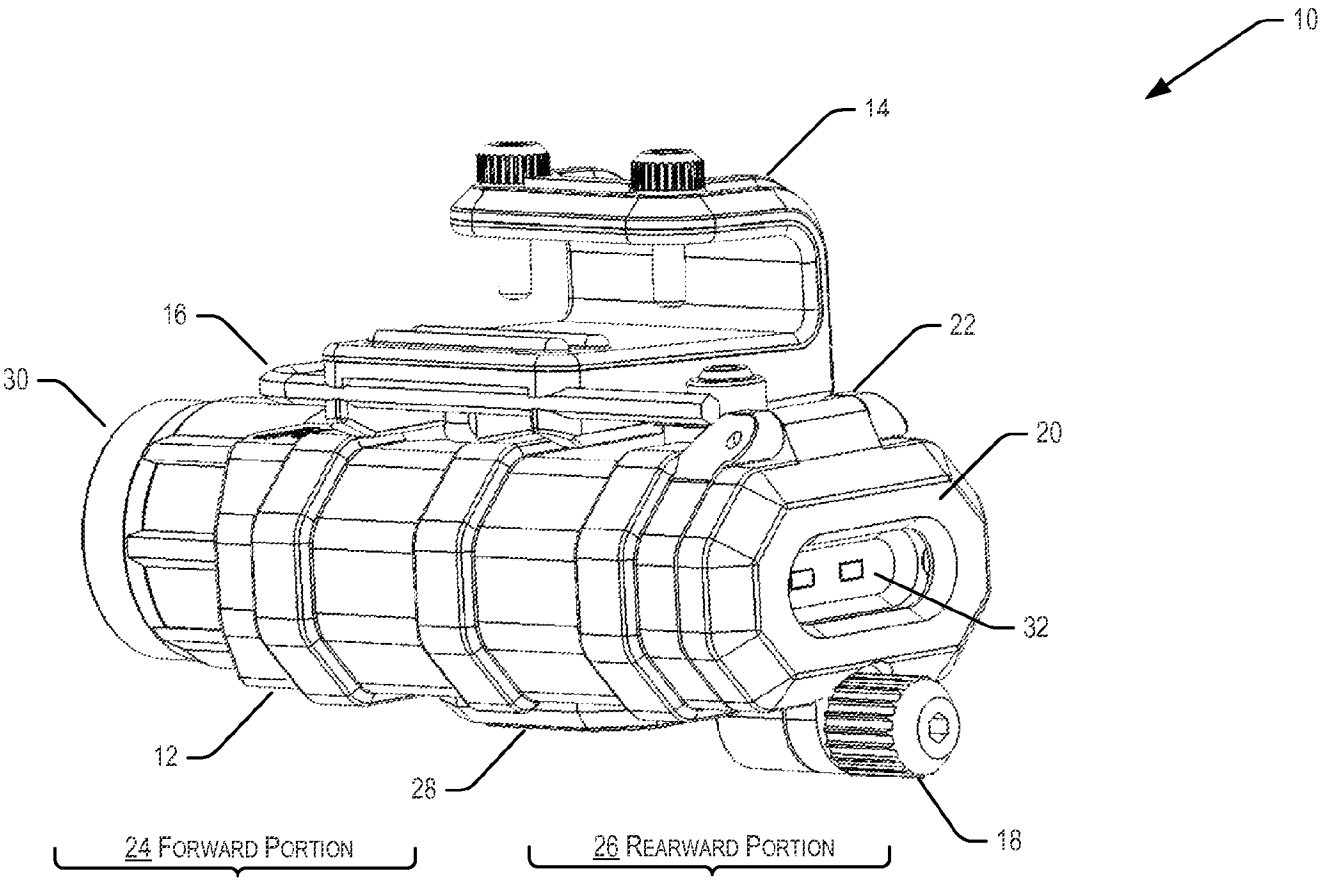
FIG. 1 illustrates a forward perspective view of a portable lighting assembly as described herein, according to at least one example.

Referring now to the drawings, in which like reference numerals represent like parts throughout the several views, FIG. 1 shows a portable lighting assembly 10 according to at least one embodiment. The portable lighting assembly 10 includes body 12 and mounting structure 14. The mounting structure 14 may be releasably secured to the body 12. Thus, in some examples, the mounting structure 14 may be removed from the body 12, leaving a hand-held lighting assembly (e.g., a flashlight). The mounting structure 14 may be configured to facilitate mounting of the portable lighting assembly 10 on an object. For example, the mounting structure 14 may be used to securely hold the portable lighting assembly 10 to a brim portion of a helmet (e.g., a firefighter's helmet, a police officer's helmet, a military helmet, and the like). In some examples, the mounting structure 14 may include different interchangeable mounting structures to facilitate mounting of the portable lighting assembly 10 to items other than brims of helmets (e.g., handle bars, backpacks, Molle mounts, etc.). The mounting structure 14 may also include tool 16. The tool 16 may be releasably secured to the mounting structure 14 and sized according to a tool-receiving surface of a retaining element 18. In accordance with at least one embodiment, the tool 16 may be a hex key tool correspondingly-sized to the retaining element 18 (e.g., a threaded bolt) of battery door 20. In this manner, the tool 16 may be accessible to a user to remove the retaining element 18 to allow the battery door 20 to rotate about hinge 22, granting access to the inside of the body 12. In some examples, the tool 16 and the retaining element 18 may be any other suitable combination of tools and fasteners (e.g., Phillips screwdriver/Phillips screw, etc.). In other examples, the retaining element 18 may be removable without the use of a tool (e.g., a thumb screw).

The body 12 may be waterproof, weatherproof, smoke proof, and the like and may include a forward portion 24 and a reward portion 26, each portion will be discussed in more detail with reference to FIG. 2. An external or primary switch 28 may be disposed on an external portion of the body 12. As illustrated in the bottom view 46 of FIG. 3, the primary switch 28 is shown as a push-button switch, mounted on the bottom side, and is accessible to a user under normal use. The primary switch 28 may be any suitable switch capable of at least opening and closing an electrical circuit between a light source and an energy source. In some examples, the primary switch 28 may be a multi-mode switch (i.e., including an "on" position, "off" position, and other positions). When the primary switch 28 is a multi-mode switch, the user may cycle through the primary switch 28 (e.g., by depressing the switch in an order, depressing and releasing the switch in a pre-defined order and/or for a pre-defined time, and the like) to turn on and off certain lights (e.g., lighting element 30, auxiliary element 32, etc.), adjust intensity of certain lights, adjust strobe/flash characteristics of certain lights, and the like. Because the primary switch 28 is mounted on the outside of the body 12, it may be easily accessible to users wearing gloves (e.g., first responders, military personnel, construction workers, recreationalists, etc.). In this manner, the primary switch 28 allows for easy operation under a wide variety of conditions.

The portable lighting assembly 10 is shown including the auxiliary element 32 disposed at the reward portion 26 and the lighting element 30 disposed at the forward portion 24. In accordance with at least one embodiment, any suitable number of lighting elements (e.g., in addition to those shown) may be included as part of the portable lighting assembly 10. As illustrated in FIG. 1, the auxiliary element 32 includes two light emitting diodes (LEDs) disposed within the battery door 20. The LEDs may be any suitable color and intensity. In some examples, the LEDs may be blue, green, red, or the like. While the auxiliary element 32 is shown including two LEDS, it is understood that any suitable number of LEDs, lasers, incandescent bulbs, or the like may be used in accordance with this disclosure. Because the auxiliary element 32 is located on the rear of the body 12 it functions to project light in a rearward direction. This may be desirable under extreme conditions to track a user of the flashlight. For example, a group of firefighters each having a portable lighting assembly mounted to his or her individual helmet brim would be able to track one another as they searched through a smoky building.

Figure 2:
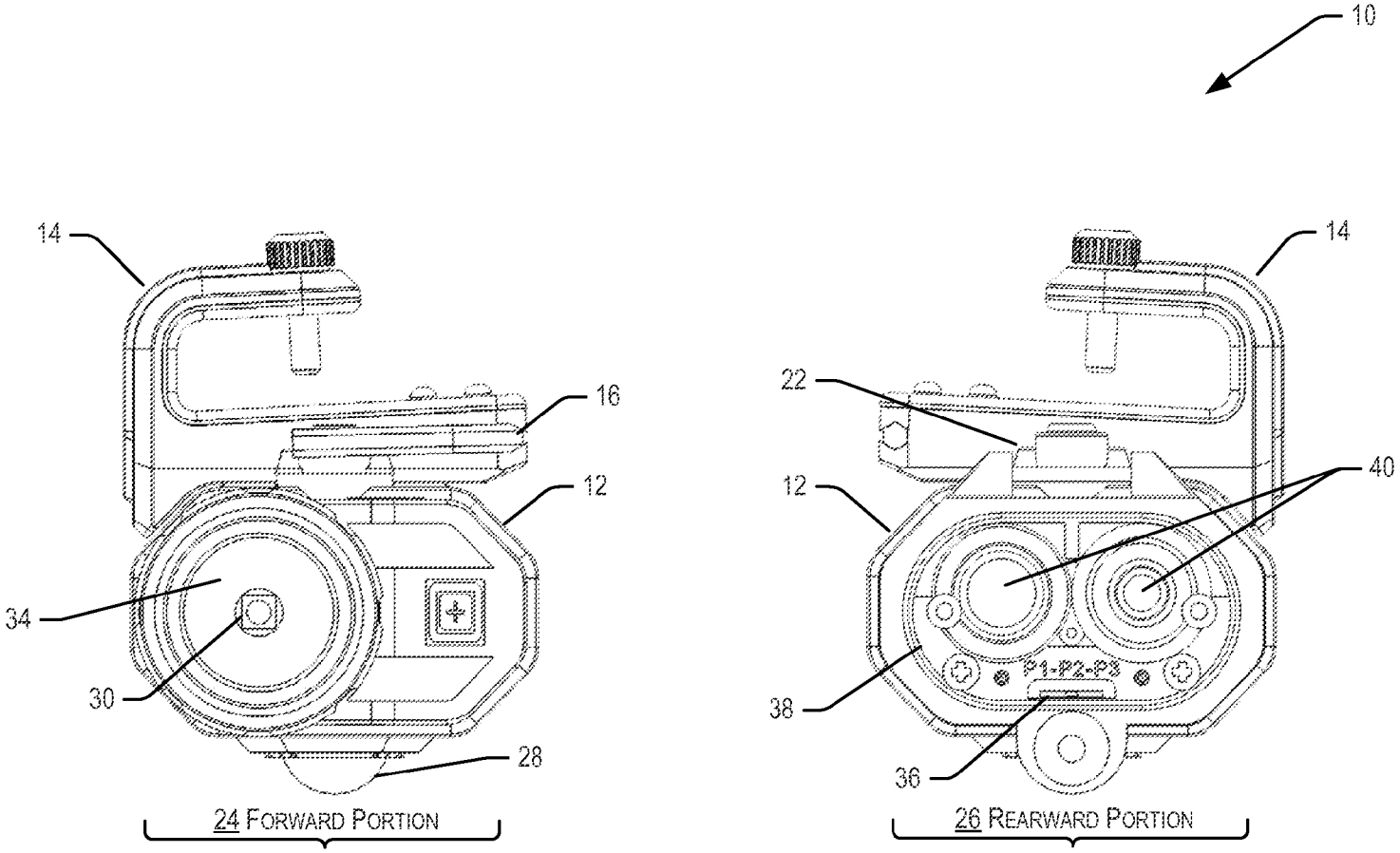
FIG. 2 illustrates a front elevation view and a back elevation view of the portable lighting assembly as described herein, according to at least one example.
Figure 3:
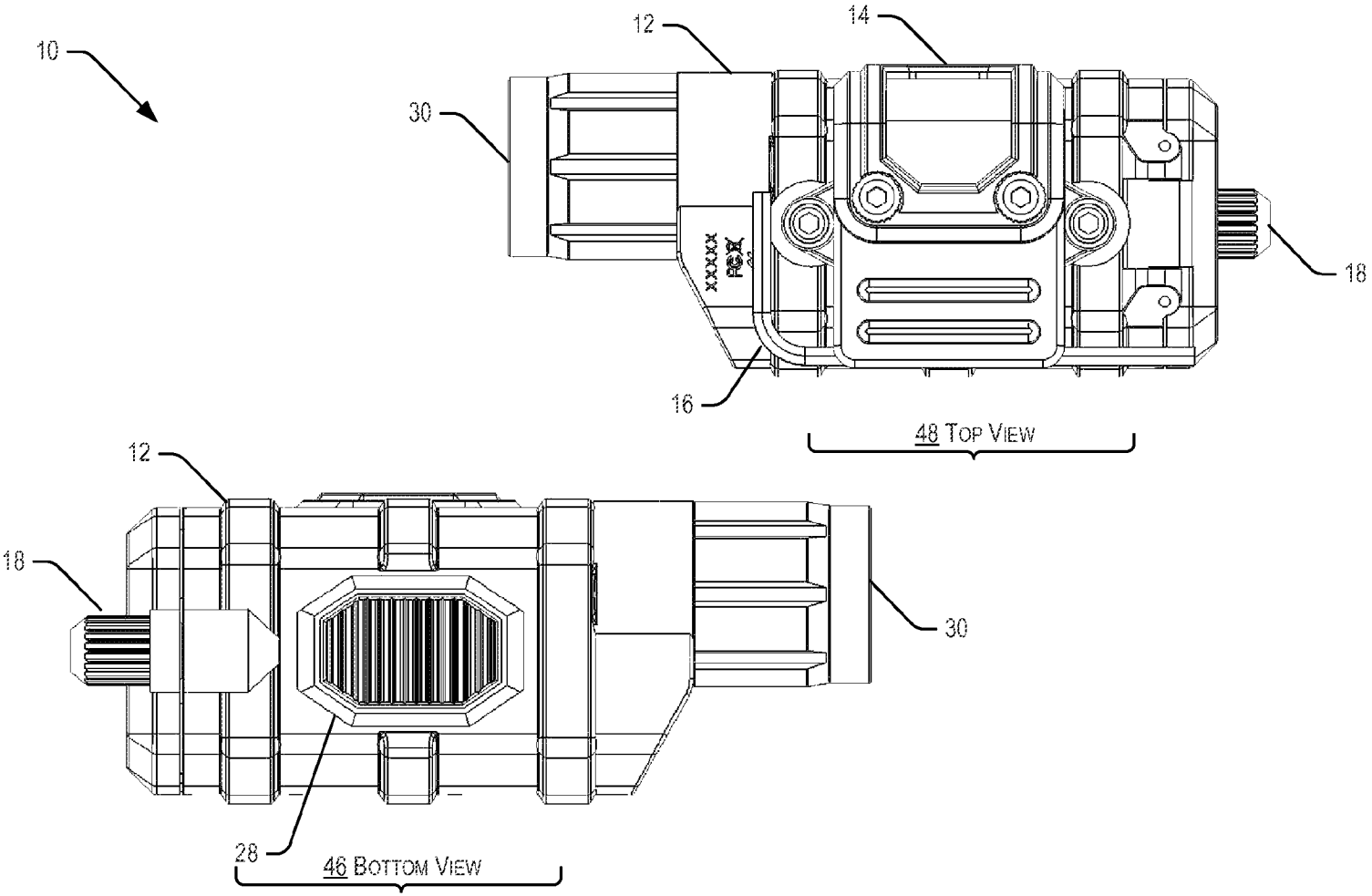
FIG. 3 illustrates a top plan view and a bottom plan view of the portable lighting assembly as described herein, according to at least one example.

As illustrated in FIG. 2, the lighting element 30 may be an LED disposed behind a lens 34. The lens 34 may have any suitable characteristics (e.g., transparent, translucent, diffusing, protector, or the like, and any combination of the foregoing), and also may include more than one lens. In some examples, the lighting element 30 may be an incandescent bulb, laser, or the like. By utilizing a combination of the lens 34, other lenses (not shown), reflectors, and adjustment mechanisms (e.g., a radial adjustment mechanism to adjust distances between reflectors, lenses, and lighting elements), the stream of light may be manipulated and/or changed to accommodate the user's preferences. Because the lighting element 30 is located on the front of the body 12 it functions to project light in a forward direction. This may be desirable to project light in the direction of movement of the user or upon an item of interest to the user. For example, a fireman entering a smoky building at night may desire to project light in a forward direction in order to avoid dangerous obstacles and to seek out survivors.

Embodiments herein are directed to at least one switching mechanism being provided on a lighting assembly, such as the portable lighting assembly 10, where the switch is not accessible to a user during normal operation of the lighting assembly. For example, the switch can be located inside a housing of the lighting assembly. In an embodiment shown in FIG. 2, an internal or adjustable switch 36 is located inside a battery compartment of a lighting assembly. In FIG. 2, the portable lighting assembly 10 is shown with the battery door 20 removed to reveal the inside of the body 12. The adjustable switch 36 may be disposed on the inside of the body 12 in compartment 38. The compartment 38 may include the entire area within the body 12. Also disposed within the compartment 38 are one or more batteries 40. While two batteries 40 are illustrated, it is understood that any suitable number of batteries, or other energy elements, may be included. As would be understood by a person of ordinary skill in the art, the batteries 40 may be any suitable batteries; including, for example, primary cells (i.e., non-rechargeable batteries), secondary cells (i.e., rechargeable batteries), and the like. In some examples, the batteries 40 may be held within separate compartment(s) within the compartment 38.

In other examples, the compartment 38 and the separate compartment(s) may be one in the same. The adjustable switch 36 may be securely mounted within the compartment 38. In some examples, the adjustable switch 36 may be held within the compartment 38 via one or more screws, chemical adhesives, a snap-fit, an interference fit, one or more pop-rivets, soldering, or the like. In accordance with at least one embodiment, the adjustable switch 36 may be mounted on an outside surface of the compartment 38, as a tailcap switch, as part of the head of the lighting assembly, or anywhere else that is assessable on the outside of the lighting assembly without access to an interior compartment or without disassembling the lighting assembly. In accordance with at least one embodiment, the adjustable switch 36 may be disposed at a location that is generally inaccessible to an ordinary user during operation of the portable lighting assembly 10. In accordance with this embodiment, the selection of a position of the adjustable switch 36 may be performed prior to the portable lighting assembly 10 being sold to users. For example, an entity may receive a plurality of portable lighting assemblies 10 and configure each differently for each of a plurality of different customers. The configurations of the portable lighting assemblies 10 may differ because the adjustable switches 36 may be adjusted to different positions for at least some of the customers. Because the position of the adjustable switch 36 controls the operation of the primary switch 28, each of adjustable switches 36 of the plurality of portable lighting assemblies 10 may function different one from another. In this manner, the portable lighting assembly 10 may be purchased with a set configuration of the primary switch 36. In accordance with this embodiment, adjustment of the adjustable switch 36 by customers may not be anticipated.

In accordance with at least one embodiment, the adjustable switch 36 may not be accessible during normal use. In other words, for a user to actuate or adjust the adjustable switch 36, the battery door 20 is first removed, the adjustment made, and the battery door 20 is replaced prior to the portable lighting assembly 10 being operational. Such a configuration may be desirable to reduce the number of switches and moving parts exposed on the exterior of the portable lighting assembly 10. In addition, the combination of the primary switch 28 and the adjustable switch 36 simplifies the operation of the portable lighting assembly 10. For example, oftentimes a user is aware of which mode of the portable lighting assembly 10 would be most useful for a particular task (e.g., a traffic officer upon making a stop at night may want a forward high intensity mode while walking to a stopped car, a rear flashing mode to identify the officer's location, a low-intensity mode for reading documents while standing near the car, and a high-intensity forward flashing mode to stun a would-be assailant). Prior to beginning the task, the user simply selects the position of the adjustable switch 36 that corresponds to the particular task and the portable lighting assembly 10 is ready to go. While performing the task, the user need only adjust one switch (i.e., the primary switch 28) to adjust the operation of the portable lighting assembly 10 to meet the user's needs. Thus, in the example of the traffic officer, he or she would be able to toggle through each mode, (or a combination of the modes), by simply actuating the primary switch 28.

Moreover, a manufacturer can preset and market a single portable lighting assembly in multiple different ways, just by changing the setting of the adjustable switch 36. In this manner, multiple circuits do not have to be designed for different options. In addition, a distributor can stock a single portable lighting assembly and set the adjustable switch of the assemblies according to marketing needs.

In the embodiment shown in FIG. 2, the adjustable switch 36 includes three positions. The three positions are indicated by "P1", "P2", and "P3," and each may correspond to a different mode of the primary switch 28. For example, when the adjustable switch 36 is in position 1 (i.e., P1), the primary switch 28 may be configured to turn on the lighting element 30 in a high intensity mode and turn on the auxiliary element 32 in response to a first action (e.g., first click), and turn off the lighting element 30 and the auxiliary element 32 in response to a second action (e.g., second click). In another example, when the adjustable switch 36 is in position 2 (i.e., P2), the primary switch 28 may be configured to turn on the lighting element 30 in a high-intensity mode and turn on the auxiliary element 32 in response to a first action (e.g., first click); turn on the lighting element 30 in a low-intensity mode and turn off the auxiliary element 32 in response to a second action (e.g., second click); and turn off the lighting element 30 in response to a third action (e.g., third click). In yet another example, when the adjustable switch 36 is in position 3 (i.e., P3), the primary switch 28 may be configured to turn on the lighting element 30 in a high-intensity mode in response to a first action (e.g., first click); turn on the lighting element 30 in a low-intensity mode in response to a second action (e.g., second click); and turn off the lighting element 30 in response to a third action (e.g., third click). In some examples, the adjustable switch 36 or the primary switch 28 may be any suitable switch, such as but not limited to a make switch, a pull switch, a rotary switch, toggle switch, a multi-position switch, pressure switch, a dual in-line package (DIP) switch, etc.

The adjustable switch 36 may include any suitable number of positions which in turn may configure any suitable number of modes of the primary switch 28. For example, the adjustable switch 36 may include less positions than the three positions illustrated in FIG. 2 or more positions than the three positions illustrated in FIG. 2. In some examples, one position of the adjustable switch 36 may correspond to one mode of the primary switch 28. Each mode of the primary switch 28 may in turn include any suitable number of operations. In order to facilitate the different operations, the primary switch 28 may be connected to a printed circuit board (PCB) and electrically coupled to a controller 42 (see FIG. 4). Based at least in part on the selected position of the adjustable switch 36, the controller 42 may electronically control the primary switch 28 to enable the operations associated with the selected mode to be brought to pass. The number of operations only depends on the type of switch selected for the primary switch 28, its configuration, and the configuration of mechanical controls, and in some cases, electronic controls (e.g., the controller 42). For example, a particular mode of the primary switch 28 may include any number of the following operations: turn on or off some or all lighting elements, adjust intensity of some or all lighting elements, adjust brightness of some or all lighting elements, adjust color of some or all lighting elements, adjust strobe characteristics of some or all lighting elements, adjust flash characteristics of some or all lighting elements, produce a sound (e.g., distress call), and the like, or any combination of the foregoing.

Figure 4:
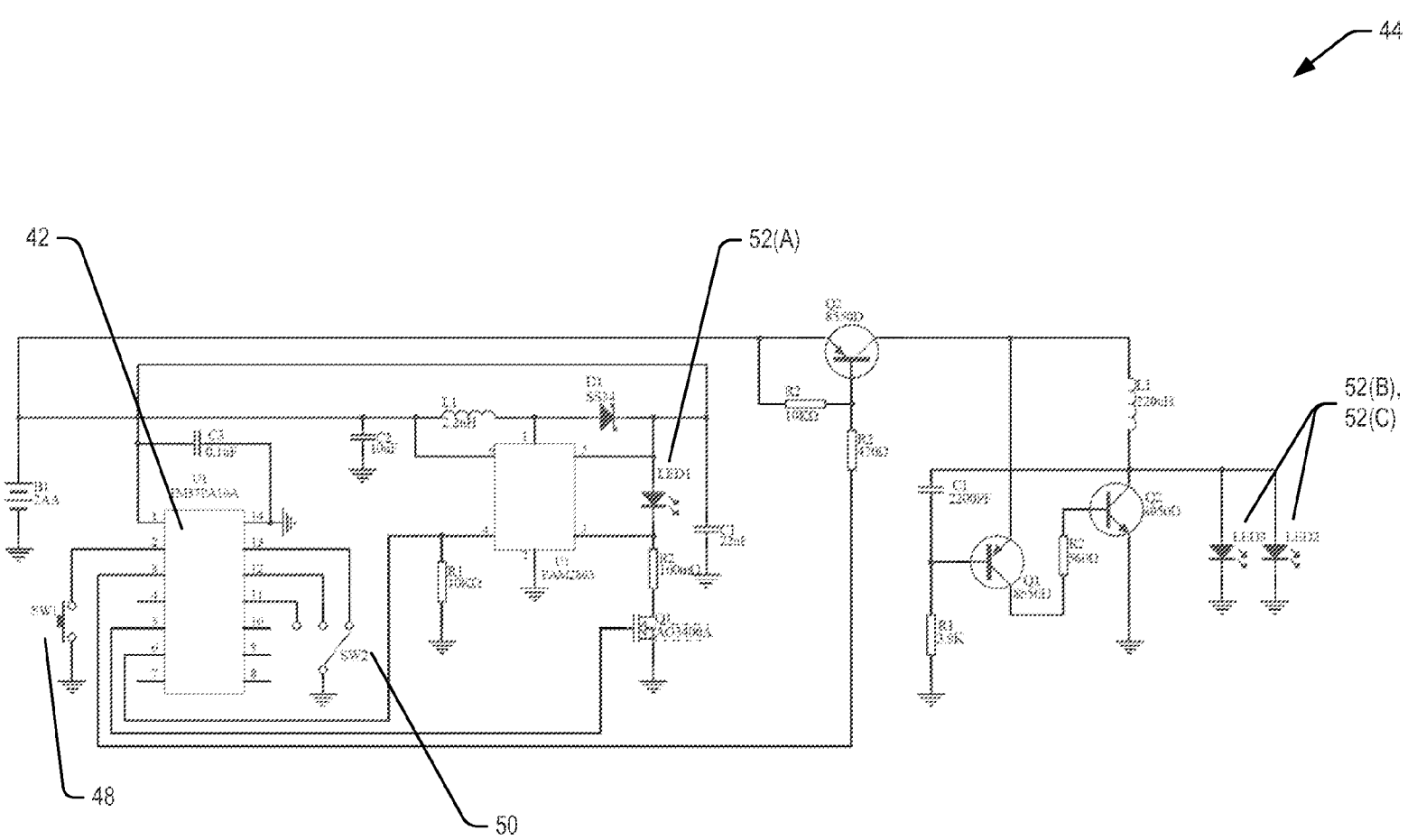
FIG. 4 illustrates an electric schematic for the portable light assembly as described herein, according to at least one example.

Turning next to FIG. 4, this figure illustrates an example electrical circuit 44 for the portable lighting assembly 10 as described herein. In accordance with at least one embodiment, a portion of the electrical circuit 44 may be included on a PCB. The electrical circuit 44 may include the controller 42, which may be any suitable controller capable of controling the operation of the portable lighting assembly 10. The electrical circuit 44 may also include a first switch 48 and a second switch 50. The first switch 48 is an example of the primary switch 28 and is illustrated in FIG. 4 as a push-button make switch. The second switch 50 is an example of the adjustable switch 36 and is illustrated in FIG. 4 as a three-position switch. The electrical circuit 44 may also include three lighting elements (i.e., 52(A)-(C)), which may be LEDs. The lighting element 52(A) is an example of the lighting element 30. The lighting elements 52(B), 52(C) are examples of the auxiliary element 32.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a," and "an," and "the," and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A portable lighting assembly comprising:

a lighting element;

a compartment configured to receive one or more battery cells;

a controller in electrical communication with the lighting element;

an adjustable switch having two or more positions, the adjustable switch disposed entirely within the compartment, secured within the compartment, and in electrical communication with the one or more battery cells and the controller; and a primary switch having at least two modes, the primary switch in electrical communication with the lighting element and the controller, and disposed on an outside surface of the compartment, each position of the adjustable switch causing a corresponding change in function for each mode provided by the primary switch via the controller for the lighting element.

2. The portable lighting assembly of claim 1, wherein the adjustable switch is accessible to a user when a door of the compartment is in an open position and inaccessible to the user when the door of the compartment is in a closed position.

3. The portable lighting assembly of claim 1, wherein individual positions of the two or more positions of the adjustable switch are associated with individual modes of the at least two modes of the primary switch.

4. The portable lighting assembly of claim 3, wherein the two or more positions comprise a first position and a second position, the first position associated with a first mode of the primary switch, and the second position associated with a second mode of the primary switch.

5. The portable lighting assembly of claim 4, wherein the first mode of the primary switch is distinct from the second mode of the primary switch.

6. The portable lighting assembly of claim 4, wherein according to the first mode, the primary switch is operable to power on the lighting element and power off the lighting element.

7. The portable lighting assembly of claim 6, wherein according to the first mode, the primary switch is further operable to power on an auxiliary element and power off an auxiliary element.

8. The portable lighting assembly of claim 3, wherein each mode of the modes of the primary switch comprises at least one of a power on function for the lighting element, a power off function for the lighting element, an intensity function for the lighting element, a color function for the lighting element, or a flashing function for the lighting element.

9. A portable lighting assembly comprising:

a lighting element;

a compartment configured to receive one or more battery cells;

a controller in electrical communication with the lighting element;

an adjustable switch having two or more positions, the adjustable switch in electrical communication with the one or more battery cells and the controller, wherein the adjustable switch is disposed within the compartment and is accessible to a user when a door of the compartment is in an open position and inaccessible to the user when the door of the compartment is in a closed position; and a primary switch having at least two modes, the primary switch in electrical communication with the lighting element and the controller, each position of the adjustable switch causing a corresponding change in function for each mode provided by the primary switch via the controller for the lighting element.

10. The portable lighting assembly of claim 9, wherein individual positions of the two or more positions of the adjustable switch are associated with individual modes of the at least two modes of the primary switch.

11. The portable lighting assembly of claim 10, wherein the two or more positions comprise a first position and a second position, the first position associated with a first mode of the primary switch, and the second position associated with a second mode of the primary switch.

12. The portable lighting assembly of claim 9, further comprising an auxiliary element in electrical communication with the primary switch and wherein the adjustable switch comprises at least three positions.

13. The portable lighting assembly of claim 12, wherein according to a first position of the adjustable switch, the primary switch is configured to:

turn on the lighting element and the auxiliary element in response to a first action; and turn off the lighting element and the auxiliary element in response to a second action.

14. The portable lighting assembly of claim 12, wherein according to a second position of the adjustable switch, the primary switch is configured to:

turn on the lighting element in a high intensity mode and turn on the auxiliary element in response to a first action;

turn on the lighting element in a low intensity mode and turn off the auxiliary element in response to a second action; and turn off the lighting element in response to a third action.

15. The portable lighting assembly of claim 12, wherein according to a third position of the adjustable switch, the primary switch is configured to:

turn on the lighting element in a high intensity mode in response to a first action;

turn on the lighting element in a low intensity mode in response to a second action; and turn off the lighting element in response to a third action.

16. A method of configuring a plurality of portable lighting assemblies, the method comprising:

obtaining a plurality of portable lighting assemblies, each of the portable lighting assemblies comprising:

a lighting element;

a compartment configured to receive one or more battery cells;

a controller in electrical communication with the lighting element;

an adjustable switch having two or more positions, the adjustable switch in electrical communication with the one or more battery cells and the controller, wherein the adjustable switch is disposed within the compartment and is accessible to a user when a door of the compartment is in an open position and inaccessible to the user when the door of the compartment is in a closed position; and a primary switch having at least two modes, the primary switch in electrical communication with the lighting element and the controller, each position of the adjustable switch causing a corresponding change in function provided by the primary switch via the controller for the lighting element;

configuring a first subset of the plurality of lighting assemblies such that the adjustable switch of each of the portable lighting assemblies of the first subset is set to a first position;

providing the first subset of the plurality of lighting assemblies to a first customer;

configuring a second subset of the plurality of lighting assemblies such that the adjustable switch of each of the portable lighting assemblies of the second subset is set to a second position; and providing the second subset of the plurality of lighting assemblies to a second customer.

17. The method of configuring a plurality of portable lighting assemblies of claim 16, wherein the compartment of each of the portable lighting assemblies of the plurality comprises a hollow structure with an opening in a rearward end, the opening sized to receive the one or more batteries, and wherein the door is configured to enclose the compartment.

18. The method of configuring a plurality of portable lighting assemblies of claim 17, wherein the lighting element of each of the portable lighting assemblies of the plurality is disposed on a forward end of the hollow structure and each of the portable lighting assemblies of the plurality comprise an auxiliary element in electrical communication with the primary switch and disposed on an exterior portion of the door.

19. A portable lighting assembly comprising:

a lighting element;

a compartment configured to receive one or more battery cells;

a controller in electrical communication with the lighting element;

an adjustable switch having two or more positions, the adjustable switch secured within the compartment and in electrical communication with the one or more battery cells and the controller; and a primary switch having at least two modes, the primary switch in electrical communication with the lighting element and the controller, and disposed on an outside surface of the compartment, each position of the adjustable switch causing a corresponding change in function for each mode provided by the primary switch via the controller for the lighting element, wherein the adjustable switch is accessible to a user when a door of the compartment is in an open position and inaccessible to the user when the door of the compartment is in a closed position.

* * * * *